US010316595B2

(12) United States Patent
Svendsen et al.

(10) Patent No.: US 10,316,595 B2
(45) Date of Patent: Jun. 11, 2019

(54) METHOD AND APPARATUS FOR REAMING AND/OR STABILIZING BOREHOLES IN DRILLING OPERATIONS

(71) Applicant: Z Drilling Holdings, Inc., Frederick, CO (US)

(72) Inventors: Zan Elden Svendsen, Denver, CO (US); Bruce M. Victor, Fort Lupton, CO (US)

( * ) Notice: Subject to any disclaimer, the term of this patent is extended or adjusted under 35 U.S.C. 154(b) by 349 days.

(21) Appl. No.: 14/941,330

(22) Filed: Nov. 13, 2015

(65) Prior Publication Data

US 2016/0138342 A1 May 19, 2016

Related U.S. Application Data

(60) Provisional application No. 62/079,470, filed on Nov. 13, 2014.

(51) Int. Cl.

| | |
|---|---|
| ***E21B 17/10*** | (2006.01) |
| ***E21B 7/28*** | (2006.01) |
| ***E21B 10/28*** | (2006.01) |
| ***E21B 17/05*** | (2006.01) |

(52) U.S. Cl.

CPC ..... *E21B 17/1078* (2013.01); *E21B 7/28* (2013.01); *E21B 10/28* (2013.01); *E21B 17/05* (2013.01)

(58) Field of Classification Search

None

See application file for complete search history.

(56) References Cited

U.S. PATENT DOCUMENTS

| | | | | |
|---|---|---|---|---|
| 2,790,623 | A * | 4/1957 | Pate | E21B 10/26 175/295 |
| D189,499 | S | 12/1960 | Sussman | |
| 3,052,310 | A | 9/1962 | Kinzbach | |
| 4,231,437 | A | 11/1980 | Swersky et al. | |
| 4,385,669 | A | 5/1983 | Knutsen | |
| D321,894 | S | 11/1991 | Harris | |
| 5,341,888 | A | 8/1994 | Deschutter | |
| 5,474,143 | A | 12/1995 | Majkovic | |
| 6,062,326 | A | 5/2000 | Strong et al. | |
| 6,213,229 | B1 | 4/2001 | Majkovic | |
| 6,349,779 | B1 | 2/2002 | Gilbert | |
| 6,401,820 | B1 | 6/2002 | Kirk et al. | |
| 6,659,173 | B2 | 12/2003 | Kirk et al. | |
| 6,983,811 | B2 | 1/2006 | Wardley | |
| 7,066,253 | B2 | 6/2006 | Baker | |

(Continued)

FOREIGN PATENT DOCUMENTS

| | | | |
|---|---|---|---|
| FR | 2877596 | A1 | 11/2004 |
| WO | 9937881 | A1 | 7/1999 |

(Continued)

*Primary Examiner* — Wei Wang

(74) *Attorney, Agent, or Firm* — Oppedahl Patent Law Firm LLC; Aileen Law

(57) ABSTRACT

Disclosed is a well bore reamer for enlarging, stabilizing and/or cleaning portions of a drilled hole. An internal clutch system comprising pins and springs cause a helical blade segment of the disclosed device to rotate about its axis in a clockwise direction during its movement in a wellbore. When the device is situated in a fixed position in the wellbore, rotation of the drill pipe causes the clutch system to lock the helical blade segment of device in place, forcing the reamer to rotate with the drill string.

7 Claims, 7 Drawing Sheets

(56) References Cited

U.S. PATENT DOCUMENTS

| | | | |
|---|---|---|---|
| 7,083,010 | B2 | 8/2006 | Eppink et al. |
| D547,778 | S | 7/2007 | Hodges |
| 7,493,971 | B2 | 2/2009 | Nevlud et al. |
| 7,506,703 | B2 | 3/2009 | Campbell et al. |
| 7,650,952 | B2 | 1/2010 | Evans et al. |
| 7,658,241 | B2 | 2/2010 | Lassoie et al. |
| 8,020,635 | B2 | 9/2011 | Radford |
| 8,162,081 | B2 | 4/2012 | Ballard et al. |
| 8,191,655 | B2 | 6/2012 | Declute-Melancon |
| 8,196,679 | B2 | 6/2012 | Radford |
| 8,201,642 | B2 | 7/2012 | Radford et al. |
| 8,297,381 | B2 | 10/2012 | Radford et al. |
| 8,336,645 | B2 | 12/2012 | Robson et al. |
| 8,381,843 | B1 | 2/2013 | Lamontagne |
| 8,434,520 | B2 | 5/2013 | Frank et al. |
| 8,453,763 | B2 | 6/2013 | Radford et al. |
| 8,584,776 | B2 | 11/2013 | Radford et al. |
| 8,607,900 | B1 | 12/2013 | Smith |
| 8,622,126 | B2 | 1/2014 | Scott et al. |
| 8,657,038 | B2 | 2/2014 | Radford et al. |
| 2001/0020552 | A1 | 9/2001 | Beaton et al. |
| 2003/0075364 | A1 | 4/2003 | Wardley |
| 2003/0155155 | A1 | 8/2003 | Dewey et al. |
| 2004/0026131 | A1* | 2/2004 | Boulet ..... E21B 17/1064 175/325.3 |
| 2005/0145417 | A1 | 7/2005 | Radford |
| 2005/0241858 | A1 | 11/2005 | Eppink et al. |
| 2006/0113113 | A1 | 6/2006 | Underwood et al. |
| 2006/0144623 | A1 | 7/2006 | Ollerensaw et al. |
| 2008/0093076 | A1 | 4/2008 | Patil et al. |
| 2008/0128174 | A1 | 6/2008 | Radford et al. |
| 2009/0114448 | A1 | 5/2009 | Laird et al. |
| 2012/0255786 | A1 | 10/2012 | Isenhour |

FOREIGN PATENT DOCUMENTS

| | | | |
|---|---|---|---|
| WO | 2007093169 | A2 | 8/2007 |
| WO | 2010085529 | A1 | 7/2010 |

* cited by examiner

METHOD AND APPARATUS FOR REAMING AND/OR STABILIZING BOREHOLES IN DRILLING OPERATIONS

FIELD OF ART

The disclosed method and system relate generally to well bore reamers for reaming ledges and cleaning loose cuttings from a drilled hole, and more specifically to a drilling device which rotates while it slides in a wellbore, and which rotates in conjunction with the drilling pipe in a wellbore when the device is positioned in a locked position with the drill pipe.

BACKGROUND

In the oil and gas industry, wellbores have been drilled by tools such as reamers, stabilizers and combination reamer and stabilizer units which are connected to a tubular drill stem or a string of drill piper at one end of the tool and a drill bit at an opposite end of the tool. These tools are used to enlarge a wellbore to a specific diameter, smooth the wall of a wellbore, help stabilize a bit, and straighten the wellbore if kinks or doglegs are encountered. Such devices can reduce lateral deviation, vibration and wobble of the drill bit, thereby improving the penetration rate of the bit in the wellbore. Additionally, the unit has the purpose of stiffening the drill collar to reduce collar deflection and the tendency of the collars in the wellbore to tilt, which may cause a drill bit to also tilt and thereby produce an oversized hole which has deviated from the desired drilling direction.

The disclosed device provides for an improved device that can be used in drilling applications which require a high degree of accuracy in drilling. The device is adapted to a string of drill pipe for use in a wellbore to center, guide and stabilize the pipe in the bore and which is capable of reaming excess subsurface materials and achieve a uniform wellbore diameter. When the disclosed device is situated in a fixed position in the drill string, a clutch system can lock the device in place—forcing the disclosed device to rotate with the drill string, thus ensuring that the disclosed device rotates with the maximum rotational torque to more effectively ream excess subsurface materials. When sliding, the drag force allows the device to disengage the clutch to allow rotation of the sleeve section to minimize torque and drag on the drill string.

SUMMARY OF THE DISCLOSURE

The disclosed device provides for a drilling tool intended to clean a wellbore, wherein the body is roughly cylindrical and comprises a top end and a bottom end, each of the ends further comprising a portion having helical blades formed of a chromoly (SAE 41xx) steel alloy, and a middle segment comprising a plurality of polycrystalline diamond compact (PDC) cutters.

The disclosed device provides for a drilling tool which is run through a wellbore and is attachable to a string of drill pipe by means of connecting the pin end of one joint into the box end of another.

The disclosed device provides for a tool comprising helical blades and an internal clutch system which cause the tool to freely rotate about its own axis in a clockwise direction (or while sliding) in a wellbore along the pipe axis.

The disclosed device provides for a clutch system that locks the device in place—forcing the disclosed device to rotate with the drill string, thus ensuring that the disclosed device rotates with the maximum rotational torque.

The helical blades of the disclosed device are bi-directional and utilize axial (lateral) drag forces in one or more directions to induce a clockwise rotation.

The disclosed device provides for a tool that when sliding, the clockwise torque of the blade geometry compresses the springs, allowing the middle reamer section to rotate about an axle of the device.

The disclosed device provides for a blade geometry that gradually increases with the outside diameter of the device, which results in a low torque response during pipe rotation and acts to minimize the forces encountered by one or more clutch pins.

The disclosed device provides for a pair of bearings located on ends of the reamer section to enable rotation of the reamer section in a sealed environment.

Although the disclosed device is not used specifically to enlarge a wellbore, it is capable of enlarging a wellbore diameter slightly, for example, if there are bends in a horizontal wellbore and gravity forces the tool to cut on the device's bottom edge. Also, it is contemplated that some embodiments could comprise eccentric reamer devices which actually enlarge a wellbore. It should be recognized that while the disclosed apparatus and method can be used as a wellbore reamer, it is also capable of being used as a stabilizer to stabilize a wellbore, These and other advantages of the disclosed device will appear from the following description and/or appended claims, reference being made to the accompanying drawings that form a part of this specification wherein like reference characters designate corresponding parts in the several views.

Before explaining the disclosed embodiments of the disclosed device in detail, it is to be understood that the device is not limited in its application to the details of the particular arrangements shown, since the device is capable of other embodiments. Also, the terminology used herein is for the purpose of description and not of limitation.

DESCRIPTION OF THE DRAWINGS

Figure 1:
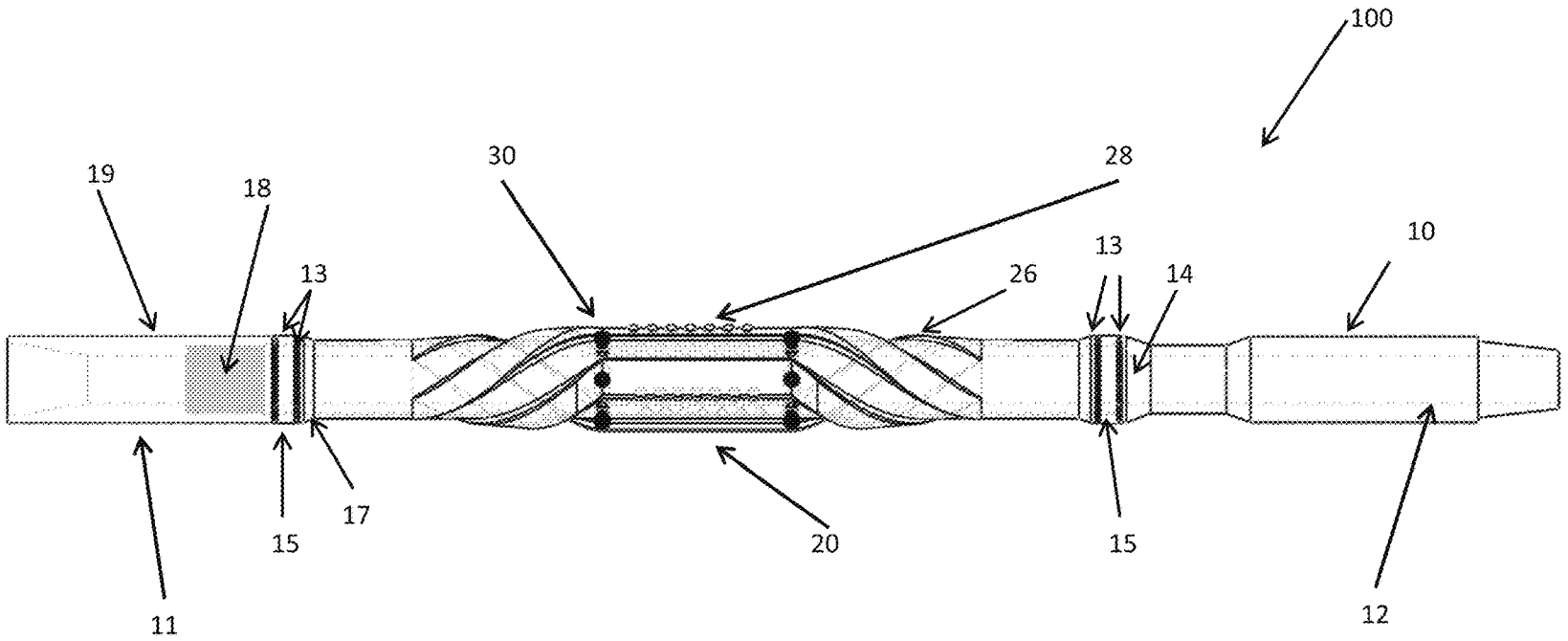
FIG. 1 is a side elevational view of the wellbore reamer/stabilizer tool disclosed herein.
Figure 3:
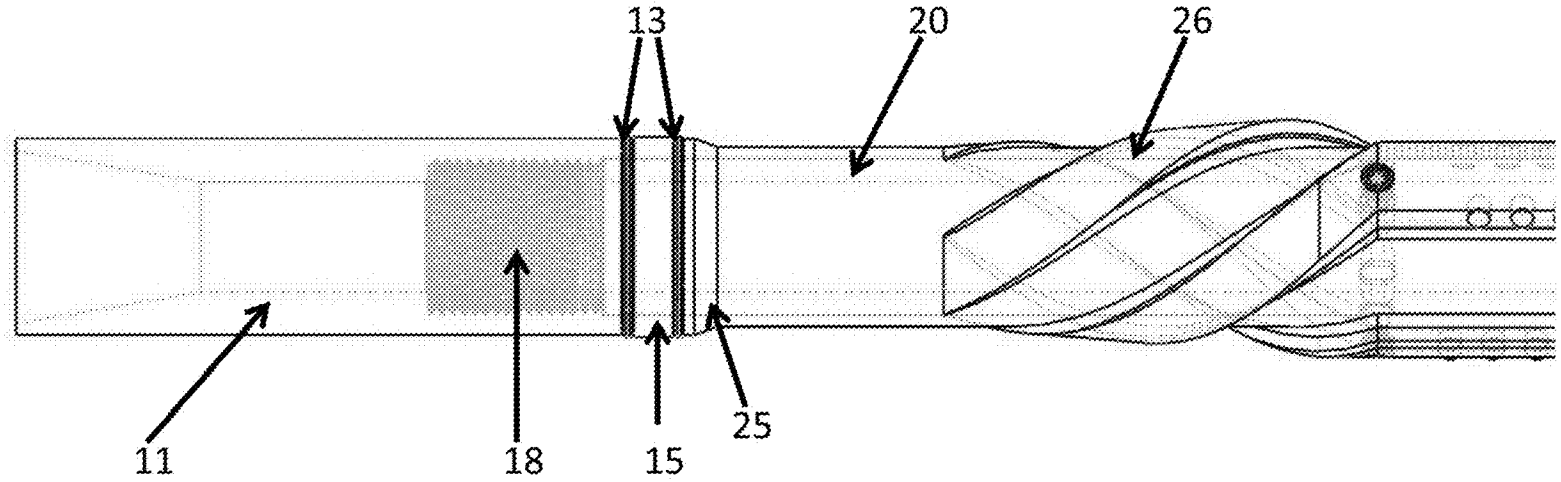
FIG. 3 depicts an axle cap in one embodiment of the disclosed device.

As shown in FIG.1, tool 100 comprises an axle 10 or a central shaft on which a reaming section 20 rotates. Axle 10 comprises a one-piece unit which may be machined from 4140 steel, for example. Axle 10 comprises a box end connection 11, a pin end connection 12, and a stop 14 for receiving bearing assembly 15 and an end of reamer section 20. An axle cap 19 can be connected to axle 10 by means of threads 18 when reaming section 20 is positioned thereon. See also FIG.3. O-rings (gaskets) 13 can be used to provide a seat between threads 18 and shoulder 17 and to provide a seal from fluid infiltration. If desired, axle cap 19 can be tightened to a specific torque value. For example, axle cap 19 may be tightened so as to obtain a certain compression on each O-ring 13. Threaded Allen screws (not shown) may be used to lock axle cap 19 in place so as to create a failsafe from the device being uncoupled.

Figure 2:
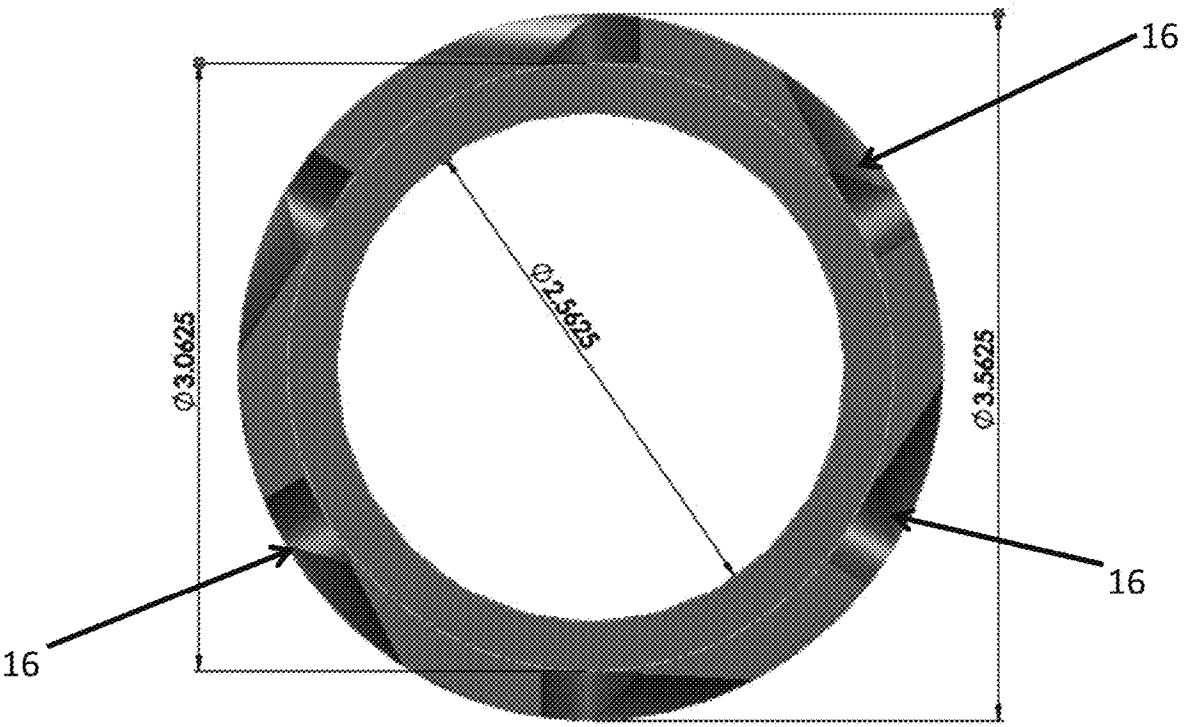
FIG. 2 is a cross-sectional view of the disclosed device taken along line 3-3.

As seen in FIG.2, axle 10 comprises one or more clutch relief grooves 16 which can be milled at any configuration of set positions as desired. In one embodiment, relief grooves 16 were machined with a ½" flat end mill (5-Axis). It is contemplated that once machining is begun, all the tool paths could be completed before un-chucking the steel from the mill. Each tool path is elliptical in shape. One groove is completed perpendicular to the pipe axis. The other at an angled path.

Figure 4:
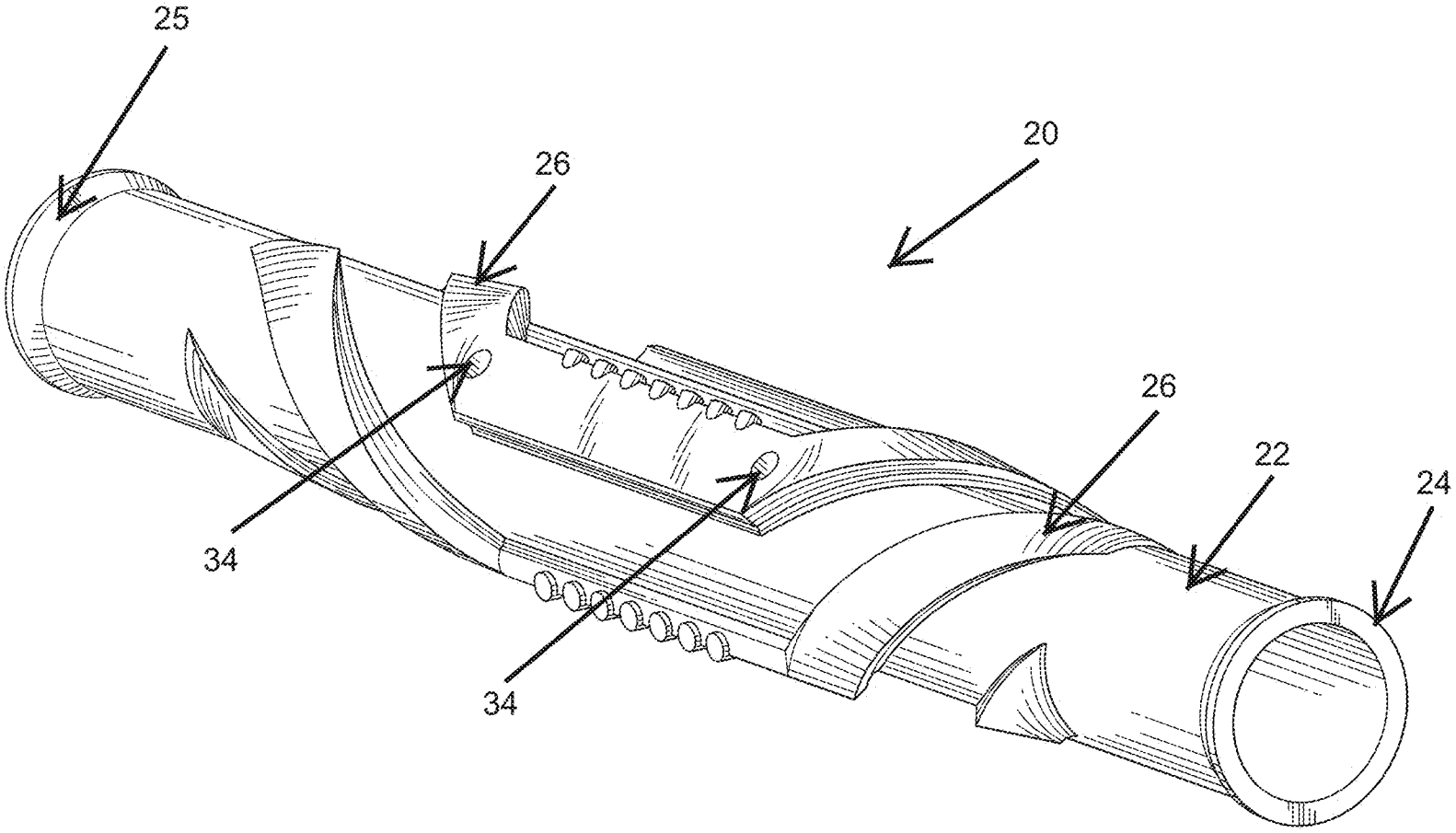
FIG. 4 is a perspective view of a reamer section of one embodiment of the disclosed device.

As shown in FIGS. 4, reaming section 20 features a hollow cylindrical body or mandrel 22 having two ends. Reaming section 20 may be machined as a unitary piece of metal from, for example 4140 steel. When assembled, reaming section 20 slides over axle 10 and is positioned between a pair of O-rings 13 and thrust bearings 15. The inner diameter of the reamer section can be set to be at about 0.05" greater than the outer diameter of axle 10, thereby allowing for a gap of about 0.025" to facilitation rotation. It should be understood that although thrust bearings were used, other bearing types could be employed.

Thrust bearings 15 allow an end of reamer section 20 to rotate against the stationary stop 14 of axle 10. O-rings 13 placed on each side of bearings 15 can be used to provide a seal between flange 24, bearing 15 and stop 14 and between box end 11, bearing 15 and flange 25 so as to keep drilling fluid from making contact with other internal systems, thereby allowing reaming section 20 to rotate in a sealed environment. Reaming section 20 rotates clockwise on axle 10 while tool 100 slides in and out of a wellbore (not shown), or during travel. When tool 100 is rotating pipe, on the other hand, reaming section 20 remains fixed on axle 10.

It should be understood that final bearing designs will be depend of engineering and safety considerations. In one embodiment, for example, bearing 15 was about 1" wide with about a 3.57" inner diameter and a 4.57" outer diameter. Regarding the O-rings, it may be helpful that the inner and outer diameters are about the same as the bearing.

Reaming section 20 comprises bi-directional helical blades 26 which utilize axial drag or lateral forces in either direction to induce clockwise rotation during operation. A material such as "Cut-Rite" (not shown) may be applied to an external surface of blades 26 to harness axial drag forces. It can extend about 0.100" above the top surface of the blades; the thickness could be in the range of about ⅜" to about ½" . In one example, a thickness of about ⅛"- about 3/16" of hard facing was used. Hardfacing could be done with a brazing rod.

As shown in FIGS. 1, 4, each blade 26 comprises seven (7) polycrystalline diamond compact (PDC) cutters (or pockets) 28. It should be recognized however that any number of cutters (or none) could be employed. If three blades 26 are used, an embodiment would comprise 21 pockets. In one embodiment, each pocket 28 was machined with a ½" flat end mill and sized to be approximately 0.536" in diameter. While each blade 26 comprising cutters 28 can be located on the same 45° plane on the blade front and are linearly aligned with each other, other cutter configurations may be more suitable or desired.

Figure 5:
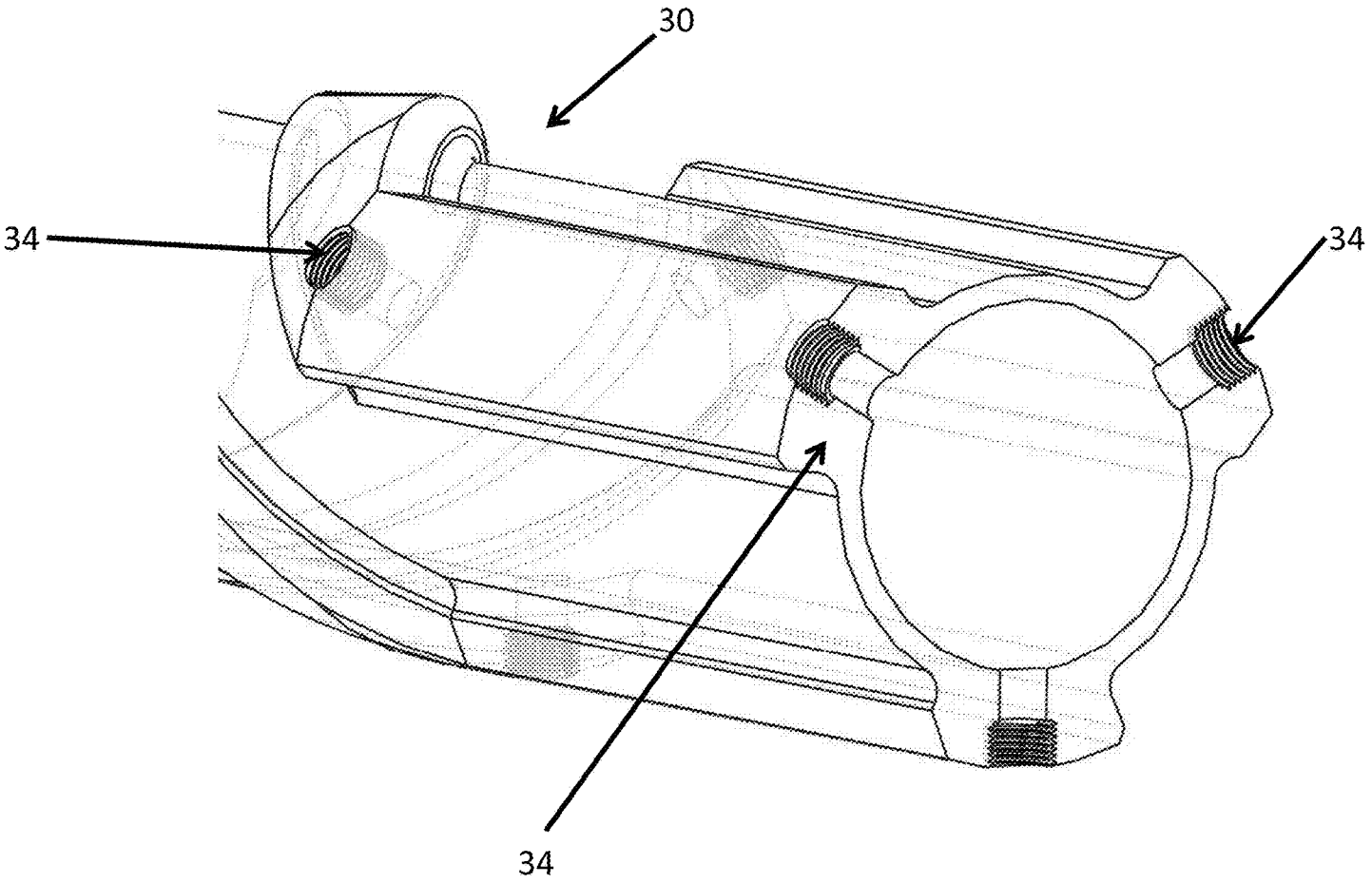
FIGS. 5, 6, 7 depict the pin and spring mechanisms on the reaming section of the disclosed device.
Figure 6:
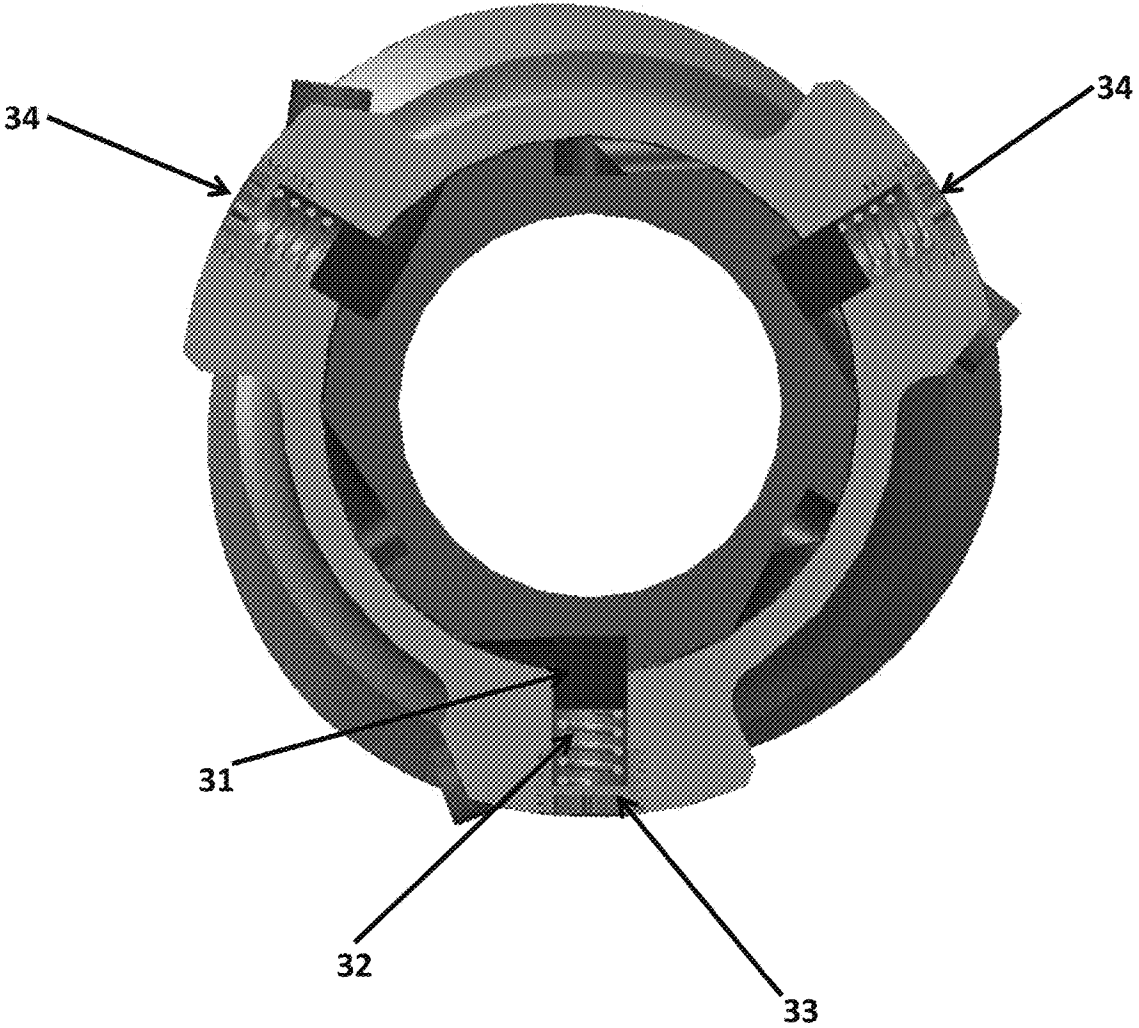
Figure 7:
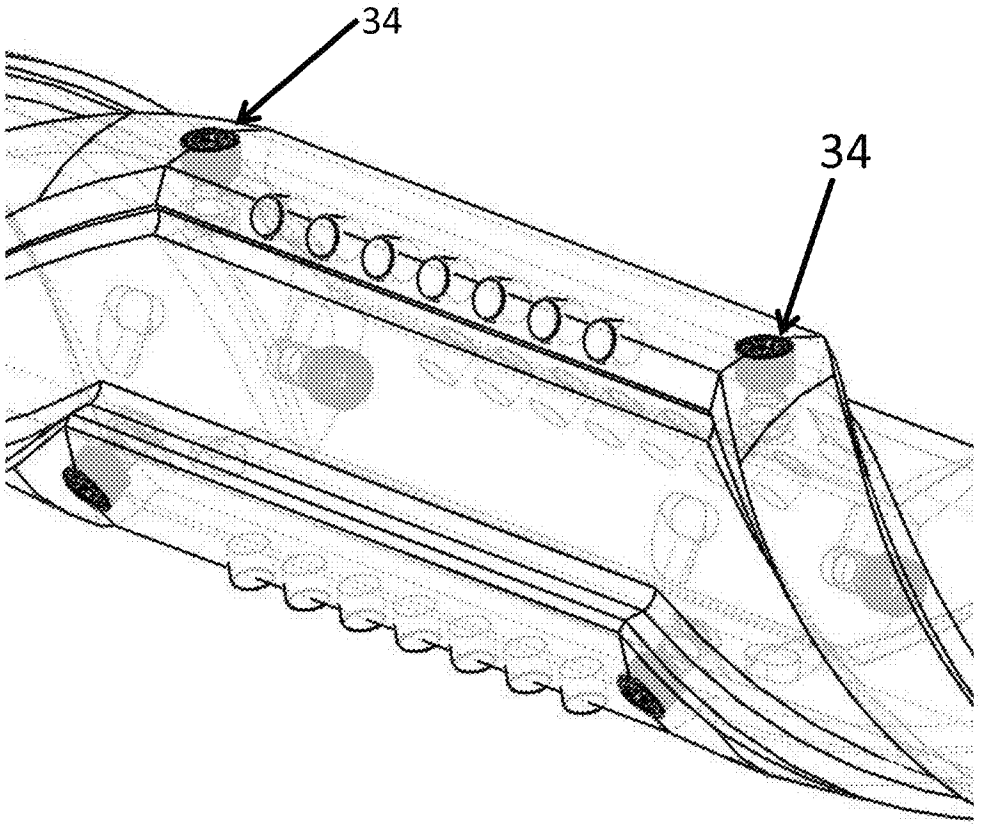

As shown in FIGS. 5, 6, 7, reaming section 20 comprises an internal clutch system 30 having a plurality of pin and spring access points 34. In one embodiment, the clutch system 30 comprises six pin and spring mechanisms that are equally positioned on each side of cutting blades 26. Clutch system 30 allows reaming section 20 to rotate clockwise while pipe is being pushed or pulled (while sliding).

In one embodiment, each access point 34 provides access to a pin and spring mechanism comprising a pin 31, a spring 32 and a cap 33. Access points 34 were machined with a ½" flat end mill and configured to be perpendicular to the pipe axis. In one embodiment, coil springs were selected for their ability to provide enough force to press clutch pins 31 into clutch reliefs 18. It was observed that springs 32 can be a max ¼" compressed and ½" uncompressed. Although coil springs were are used, other spring types could also be suitable.

In one embodiment, clutch pin 31 comprises a ½" diameter tungsten carbide insert about ½" in length that can be positioned so that shear forces apply zero or little torque to reamer section 20. It may be desirable to use the softest tungsten available to minimize steel body wear and decrease brittleness. Although the clutch pin may be set to only travel ¼41 when transitioning between the locked to rotating positions, it is contemplated that other travel distances may be more suitable. The clutch pin cap 33 may contain a cavity that allows spring 32 to fully compress. It may be threaded to a stopping point and held in place by a lock tight so as to keep the clutch pin in position. It should be understood that although pin and spring—based clutch system is described, other clutch mechanisms could be employed depending on sizing requirements.

The clockwise torque provided by the blade geometry compresses springs 32, thereby allowing the reamer section 20 to rotate on axle 10. When pipe is being rotated, springs 32 of clutch system 30 expand and thus create a torsional lock thereby allowing one or more surfaces to make contact with the outer diameter of the wellbore.

In one embodiment, tool 100 was approximately 80" in length and weighed about 300 pounds after assembly. The blade geometry presented by the disclosed device provides for a gradual increase in the tool's outer diameter until it reaches a cutter value of approximately 5.875" and a low torque response during pipe rotation. This low torque response also minimizes the forces on the clutch pins.

To assemble the device, a user should begin with a box end 11 of axle 10 and fasten an O-ring 13 and bearing 15 thereto before attaching reamer section 30 followed by an O-ring 13 and bearing 15 followed by an O-ring 13 and axle cap 19. Before assembly it would be good practice to ensure both the outer surface of axle 10 and the inner surface of reamer section 20 are cleaned and lubricated with a grease such as "Pedros". It is also contemplated that each side of the bearings 15 and O-rings 13 are lubricated.

After axle cap 19 has been threaded into position and torqued to the desired specifications, the pin and spring system 34 can be assembled. One could rotate reamer section 20 on axle 10 until pins 31 are at the lowest point. This allows for ease in threading caps 33 into place. It is contemplated that caps 33 be coated with Loctite™ before being threaded to their stop points.

It is contemplated that the disclosed device or rotate-while-sliding (RWS) device, as assembled, is approximately 80 inches (2.032 m) in length. It is also contemplated that the device could be designed to rotate in a counter-clockwise direction, if desired.

Although the disclosed device and method have been described with reference to disclosed embodiments, numerous modifications and variations can be made and still the result will come within the scope of the disclosure. No limitation with respect to the specific embodiments disclosed herein is intended or should be inferred.

What is claimed:

1. A reamer and stabilizer device comprising:

an axle section connectable to a drill string;

a sleeve section slidably mounted over said axle section;

a clutch that is capable of locking said axle section to said sleeve section;

said sleeve section having helical blades to ream the inner diameter of a wellbore when the drill string is sliding;

a reaming section freely rotatable about said axle section when the drill string stops sliding;

wherein a clockwise torque of the helical blades unlocks the clutch, allowing the sleeve section to rotate about the axle section and the drill string; and wherein the clockwise torque of the helical blades causes a compression of at least one spring mechanism.

2. The device of claim 1, wherein the helical blades further comprise at least one cutter.

3. The device of claim 1, wherein the sleeve section is a reamer.

4. The device of claim 1, wherein the sleeve section is a stabilizer.

5. The device of claim 1, wherein the helical blades are bi-directional.

6. The device of claim 1, wherein the helical blades are bi-directional.

7. The device of claim 1, wherein the reaming section further comprises a pair of bearings to facilitate a seal.

* * * * *